United States Patent [19]

Oyaizu

[11] Patent Number: 4,726,331

[45] Date of Patent: Feb. 23, 1988

[54] MEANS FOR VARIABLE VALVE TIMING FOR ENGINE

[75] Inventor: Takeshi Oyaizu, Iwata, Japan

[73] Assignee: Yamaha Hatsudoki Kabushiki Kaisha, Japan

[21] Appl. No.: 47,053

[22] Filed: May 6, 1987

[30] Foreign Application Priority Data

| | | | |
|---|---|---|---|
| May 6, 1986 | [JP] | Japan | 61-101991 |
| Jun. 20, 1986 | [JP] | Japan | 61-142762 |
| Sep. 1, 1986 | [JP] | Japan | 61-203647 |

[51] Int. Cl.[4] ..... F01L 1/34

[52] U.S. Cl. ..... 123/90.15; 123/90.31

[58] Field of Search ..... 123/90.15, 90.16, 90.31, 123/55 VF, 55 VS, 55 VE, 55 V

[56] References Cited

U.S. PATENT DOCUMENTS

| | | | |
|---|---|---|---|
| 2,010,056 | 8/1935 | Brush | 123/90.31 |
| 3,441,009 | 4/1969 | Rafanelli | 123/90.15 |
| 3,496,918 | 2/1970 | Finlay | 123/90.15 |
| 3,888,217 | 6/1975 | Hisserich | 123/90.31 |
| 4,576,127 | 3/1986 | Doi et al. | 123/90.15 |
| 4,685,429 | 8/1987 | Oyaizu | 123/90.15 |

FOREIGN PATENT DOCUMENTS

| | | | |
|---|---|---|---|
| 3506106 | 8/1985 | Fed. Rep. of Germany | 123/90.31 |
| 3509094 | 10/1985 | Fed. Rep. of Germany | 123/90.15 |
| 159904 | 10/1982 | Japan | 123/90.31 |
| 166705 | 8/1983 | Japan | 123/90.15 |
| 12108 | 1/1984 | Japan | 123/90.15 |
| 651109 | 8/1985 | Switzerland | 123/90.15 |

*Primary Examiner*—Ira S. Lazarus

*Attorney, Agent, or Firm*—Ernest A. Beutler

[57] ABSTRACT

Several embodiments of variable valve timing arrangements for double overhead camshaft engines having cylinder banks disposed at an angle to each other. In each embodiment, the variable timing is achieved by means of a pair of idler sprockets that are disposed between the camshafts of the respective cylinder banks and which are operated in unison so as to rotate the camshafts in an appropriate direction to achieve simultaneous valve timing adjustment of all camshafts in the desired relationship. In addition, an improved arrangement is disclosed for driving the camshafts of one cylinder bank from those of another cylinder bank.

18 Claims, 20 Drawing Figures

MEANS FOR VARIABLE VALVE TIMING FOR ENGINE

BACKGROUND OF THE INVENTION

This invention relates to a means for variable valve timing for engines and more particularly to an improved valve driving arrangement for an internal combustion engine.

A wide variety of systems have been proposed for varying the valve timing of an internal combustion engine so as to improve its performance. Variable valve timing engines can have the overlap between the intake and exhaust valve vents altered to suit varying running conditions and provide optimum performance over a wide variety of running conditions. For this reason, there is a considerable interest in such variable valve timing mechanisms.

However, one reason why variable valve timing has not enjoyed wider application is its complexity. This problem is particularly acute in connection with engines having banks of cylinders such as V type or opposed engines. Where such engines employ camshafts for the cylinder heads of each bank, it is necessary to insure that the valve timing of the camshafts of the various cylinder heads be adjusted simultaneously so that there is not an abnormal or uneven running condition for the cylinders of the various banks. Because of the previously proposed variable valve timing mechanisms, the application of this principle to V type engines has been severely limited.

It is, therefore, a principal object of this invention to provide an improved variable valve timing device for an internal combustion engine.

It is a further object of this invention to provide an improved and simplified arrangement for achieving variable valve timing for an engine having angularly disposed cylinder banks in a simple and yet effective manner.

It is a further object of this invention to provide a variable valve timing arrangement for an engine having angularly disposed cylinder banks and wherein all camshafts may be adjusted simultaneously by means of a single actuator.

In additional to the aforenoted difficulties in connection with the driving of the camshafts of an engine having angularly disposed cylinder banks and achieving variable valve timing, the drive of the camshafts of the engine per se present several problems. For example, it is desirable to minimize the number of flexible transmitters (either chains or driving belts) that are employed for driving the various camshafts of such engines. By employing only a single flexible transmitter for driving all camshafts, the likelihood of the camshafts becoming out of time with each other is substantially reduced.

There are difficulties that are presented in connection with driving the camshafts of the cylinder banks from each other, however. That is, a portion of the flexible transmitter extends from the camshaft of one cylinder bank to the camshaft of another cylinder bank so as to transfer the drive between the camshafts of the cylinder banks. Normally this is done by including an idler sprocket that is positioned in the bank of the V so as to drive the camshafts of the cylinder banks from each other. However, the use of such an idler sprocket adds considerably to the length of the flexible transmitter and it is desirable to maintain the transmitter length as short as possible so as to avoid the disadvantages encountered when the flexible transmitter stretches, which is natural in operation. The previous type of drives for camshafts employed have, however, not permitted a direct straight flight of the flexible transmitter to exist between the camshaft of one cylinder bank and a camshaft of the other cylinder bank for transmitting the drive between them. The reason for this is that the previous type of drive arrangements have been that such a direct flight between the camshafts of the cylinder banks would substantially minimize the amount of contact between the flexible transmitter and the camshafts. It is desirable to insure that there is a substantial circumferential area of contact between the transmitter and the camshaft sprocket or pulley so as to insure that the drive will not jump out of time.

It is, therefore, a still further object of this invention to provide an improved, simplified and yet effective arrangement for driving the camshafts of engines having cylinder banks disposed at an angle to each other by means of a single flexible transmitter.

SUMMARY OF THE INVENTION

A first feature of this invention is adapted to be embodied in a variable timing camshaft drive for an internal combustion engine that has a first cylinder bank and a first camshaft rotating about a first axis for operating at least one valve associated with the first cylinder bank. A second cylinder bank is disposed at an angle to the first cylinder bank and a second camshaft rotates about a second axis for operating at least one valve associated with the second cylinder bank. A drive sprocket is driven by the engine and is rotatable about a third axis. A single flexible transmitter is trained about the first and second camshafts and the drive sprocket for driving the first and second camshafts in unison with each other. In accordance with this feature of the invention, means are provided for simultaneously rotating the first and second camshafts in the same direction relative to the drive sprocket and independently of the drive sprocket for simultaneously changing the events of the valves operated by the camshaft in the same sense.

Another feature of the invention is adapted to be embodied in a camshaft drive system for an internal combustion engine that comprises a first cylinder bank, a first cylinder head affixed to the first cylinder bank and defining at least a first combustion chamber, and first and second camshafts journaled for rotation relative to the first cylinder head about parallel first and second axes. A second cylinder bank is disposed at an angle to the first cylinder bank and has affixed to it a second cylinder head which defines at least a second combustion chamber. Third and fourth camshafts are journaled for rotation relative to the second cylinder head about parallel third and fourth axes. A drive sprocket is driven by the engine and a single flexible transmitter is trained around the drive sprocket and the first, second, third and fourth camshafts for driving all of the camshafts in unison with the drive sprocket. In accordance with this feature of the invention, the portion of the flexible transmitter extending between the second and third camshafts comprises a single straight flight that is not interengaged with an idler sprocket.

DETAILED DESCRIPTION OF THE PREFERRED EMBODIMENTS

Figure 1:
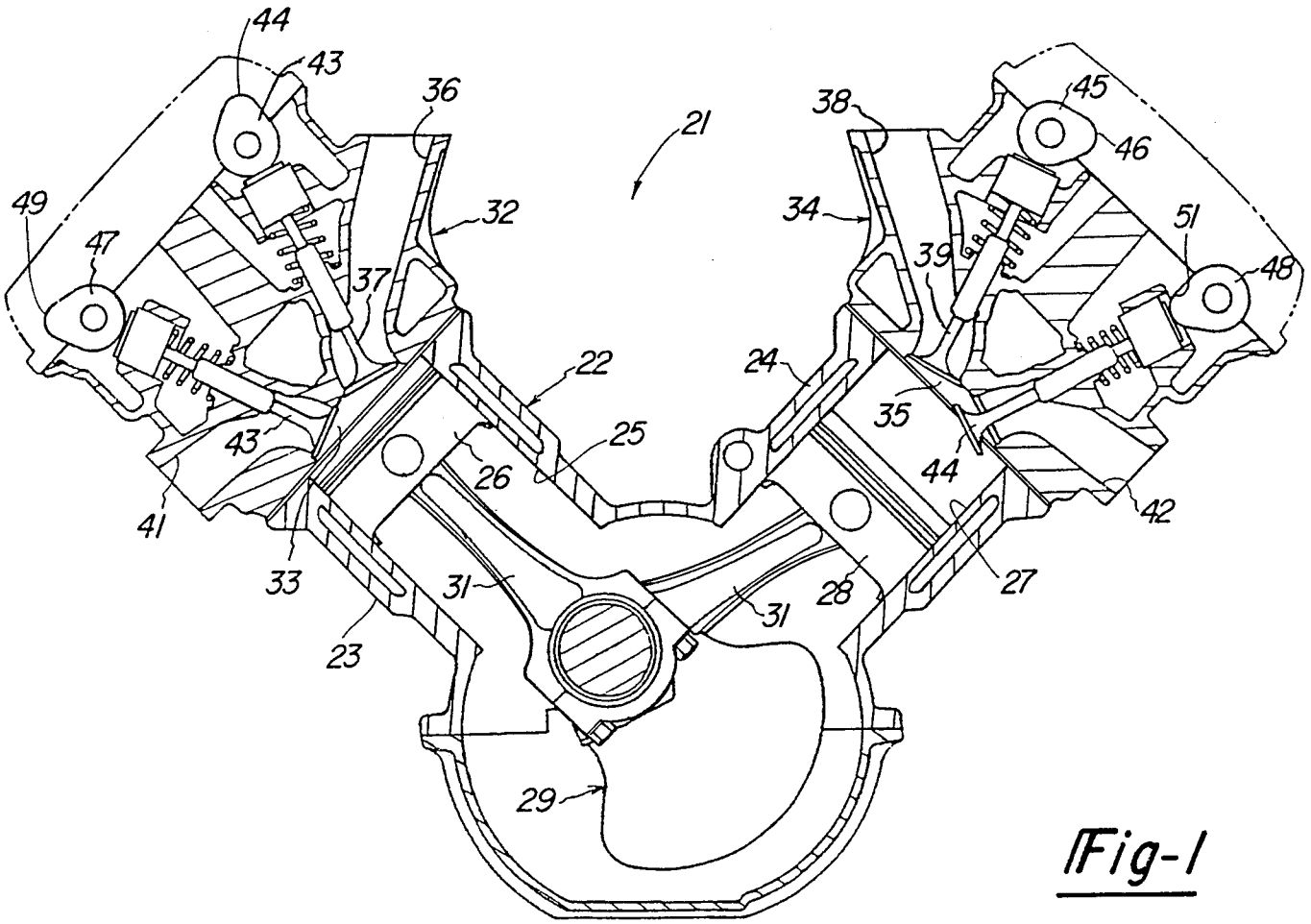
FIG. 1 is a cross-sectional view of an internal combustion engine constructed in accordance with a first embodiment of the invention, which cross-section is taken along a plane perpendicular to the axis of rotation of the engine output shaft.

Referring first to FIG. 1, an internal combustion engine constructed in accordance with this embodiment of the invention is identified generally by the reference numeral 21. FIG. 1 is a cross-sectional view taken through a pair of cylinders of the engine and, for that reason, this figure is typical of the basic engine constructions of all of the embodiments illustrated and described. As will become apparent, the embodiments differ from each other only in connection with the camshaft drive mechanism and the mechanism for achieving variable valve timing. For that reason, FIG. 1 may be considered to be typical of the engine of all embodiments except for the camshaft drive arrangement.

Referring again to FIG. 1, the engine 21 is comprised of a cylinder block, indicated generally by the reference numeral 22, which has a first cylinder bank 23 and a second cylinder bank 24. In the illustrated embodiment, the cylinder banks 23 and 24 are disposed at an right angle to each other, as would be typical with a V8 type of engine. However, it is to be understood that the invention may be employed in connection with engines having cylinder banks at different angles to each other or, for that matter, certain features of the invention may be employed in connection with engines having inline cylinders. However, the major facets of the invention have particular utility in connection with engines having cylinder banks disposed at an angle to each other including opposed engines.

The cylinder bank 23 is provided with a plurality of cylinder bores 25 in which pistons 26 are supported for reciprocation. In a similar manner, the cylinder bank 24 is provided with a plurality of cylinder bores 27 in which pistons 28 are supported for reciprocation. The pistons 26 and 28 are connected to a crankshaft 29, which rotates about a generally longitudinally disposed axis, by means of respective connecting rods 31, in a known manner.

A first cylinder head, indicated generally by the reference numeral 32, is affixed to the cylinder bank 23 and is provided with a plurality of recesses 33 equal in number to the number of cylinder bores 25 to form the combustion chambers. In a like manner, a cylinder head, indicated generally by the reference numeral 34, is affixed to the cylinder block 24 and has respective recesses 35 which cooperated with the cylinder bores 27 of this bank to form the combustion chambers.

The cylinder head 32 is provided with a plurality of intake passages 36 that are disposed on the inside of the V of the engine and which terminate at respective intake ports for each of the combustion chambers 33. A respective intake valve 37 is slidably supported in the cylinder head 32 for controlling the flow through each of the intake passage 36. In a similar manner, the cylinder head 34 is provided with intake passages 38 that terminate in valve seats that are controlled by intake valves 39 slidably supported in the cylinder head 34. It should be noted that the intake valves 37 and 39 of the cylinder heads 34 and 32 are disposed adjacent to each other.

The cylinder heads 32 and 34 are also provided with respective exhaust passages 41 and 42 on the outside of the V which terminate in exhaust ports that communicate with the respective combustion chambers 33 and 35. Exhaust valves 43 and 44, respectively, are supported in the cylinder heads 32 and 34 for controlling the flow through the exhaust passages 41 and 42.

An intake camshaft 43 is rotatably journaled relative to the cylinder head 32 in any known manner about an axis parallel to the axis of rotation of the crankshaft 29 and has lobes 44 that cooperate with the intake valves 37 for opening and closing them. In a similar manner, an intake camshaft 45 is supported relative to the cylinder head 34 for rotation about a parallel axis and has lobes 46 for operating the intake valves 39 of this cylinder head. Similarly, the cylinder heads 32 and 34 rotatably journal exhaust camshafts 47 and 48, respectively about further, parallel axes, that have cam lobes 49 and 51 for operating the respective exhaust valves 43 and 44.

It should be noted that the engine as thus far described includes a single intake valve and a single exhaust valve for each combustion chamber of the engine. It is to be understood, however, that the invention may be utilized with engines having more than two valves per cylinder. However, the invention has particular utility in engines wherein all of the intake valves for each cylinder bank are operated by the same camshaft and all of the exhaust valves are also operated by a single camshaft per cylinder bank. Of course, as will be readily apparent to those skilled in the art, certain facets of the invention can be utilized in conjunction with other type of valve arrangements including those not employing overhead mounted camshafts.

As has been previously noted, the invention is directed primarily toward the drive for the camshafts 43, 45, 47 and 48 and not to any basic components of the engine other than the camshaft drive. For that reason, further description of the basic components of the engine are not believed to be necessary and the remaining portions of this embodiment will now be described by particular reference to FIGS. 2 through 6.

Figure 2:
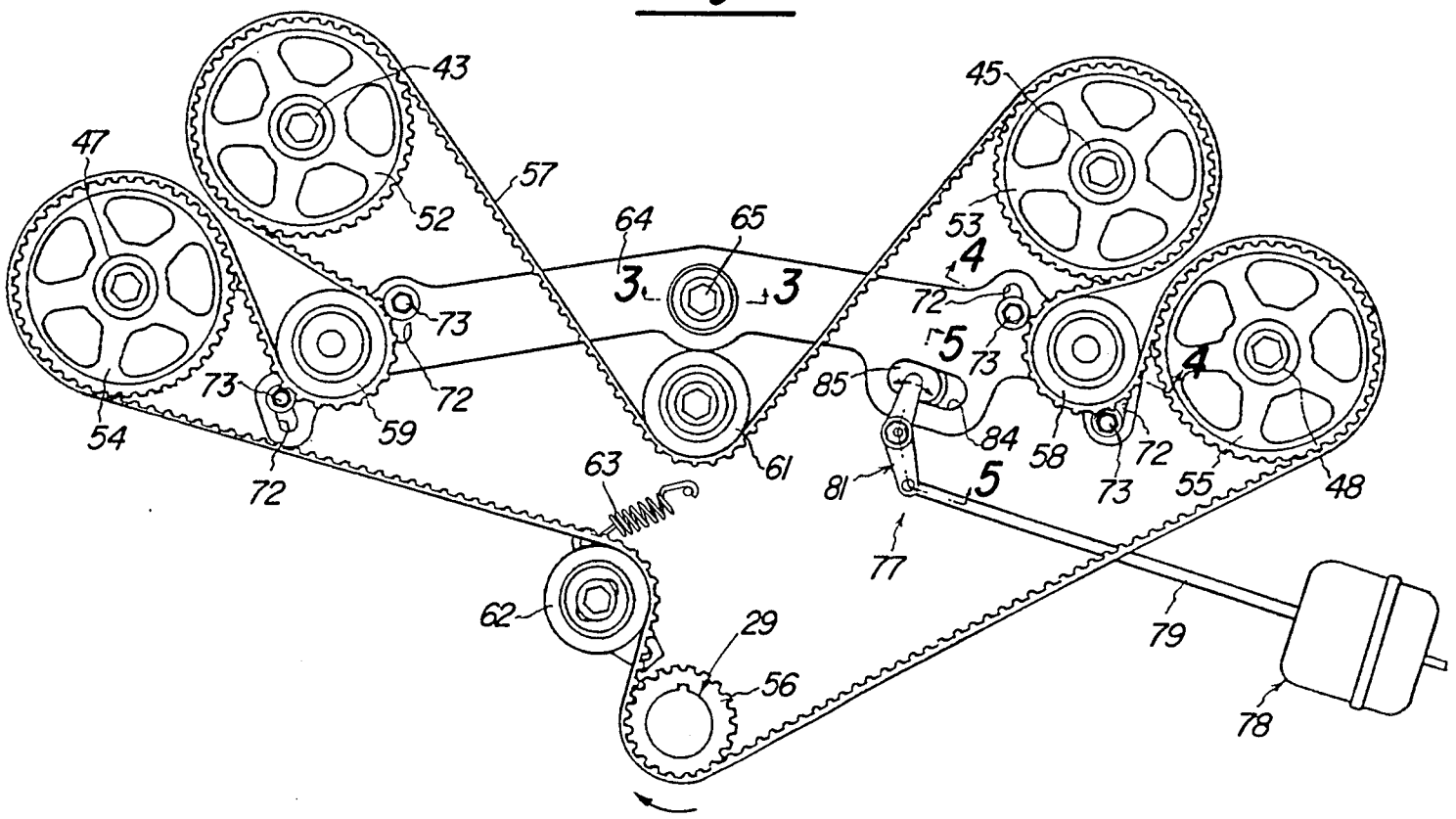
FIG. 2 is a front elevational view of the camshaft driving arrangement of the engine shown in FIG. 1.

Referring first to FIG. 2, it will be noted that sprockets 52 and 53 are affixed for rotation with the intake camshafts 43 and 45 of the respective cylinder heads 32 and 34. In a similar manner, sprockets 54 and 55 are affixed to the exhaust camshafts 47 and 48 of the respective cylinder heads. A driving sprocket 56 is affixed for rotation with the crankshaft 29. A single toothed timing belt 57 is trained around the sprockets 56, 55, 53, 52 and 54 in that order for driving the camshafts 48, 45, 43 and 47. Although the invention is described in conjunction with a toothed timing belt, it is to be understood that other flexible transmitter drives such an endless chains may be employed for the same purpose.

The portion of the timing belt passing between the sprockets 55 and 53 is trained around an idler sprocket 58. The idler sprocket 58 is disposed inwardly of a plane containing the axis of the camshafts 45 and 48 toward the axis of the crankshaft 29. It will be noted that the sprockets 53 and 55 are placed closer together than the diameter of the idler sprocket 56 and the resulting arrangement insures that the timing belt 57 engages more than 180 degrees of the circumference of the sprockets 53 and 55. This insures that the drive is not likely to jump out of time.

A similar idler sprocket 59 is positioned between the sprockets 52 and 54 and the portion of the timing belt 57 that passes between these two sprockets extend around the idler sprocket 59 for the same purpose as aforedescribed.

An idler sprocket 61 is positioned between the intake camshaft sprockets 52 and 53 and is disposed toward the bight of the V so that a flight of the belt 57 will pass inwardly from the sprocket 53 to the idler sprocket 61 and then back outwardly to the sprocket 52 in a generally conventional fashion.

A combined belt tensioning and idler sprocket 62 is pivotally supported on the cylinder block in proximity to the crankshaft driven sprocket 56 on the idler side of the belt 57 and is urged in a belt tensioning direction by means of a tension spring 63 for maintaining a uniform tension in the timing belt 57.

In accordance with the invention, an arrangement is provided for rotating the camshafts 43 and 45 and the crankshafts 47 and 48 all simultaneously and through the same angle but in opposite senses, as will be described, so as to alter the timing events of the intake and exhaust valves of the respective cylinders. This is accomplished without any rotation of the driving sprocket 56.

Figure 3:
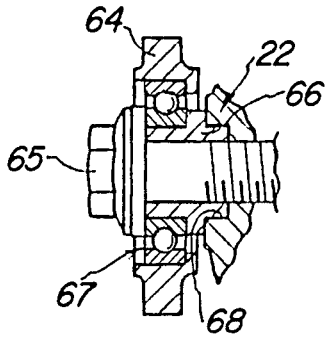
FIG. 3 is an enlarged cross-sectional view taken along the line 3—3 of FIG. 2.

To this end, there is provided a bellcrank 64 that is pivotally supported intermediate its ends by means of a pivot assembly as best shown in FIG. 3 which includes a pivot bolt 65 that is threaded into the cylinder block 22. The pivot bolt 65 is provided with a bushing 66 which supports an anti-friction bearing 67 which, in turn, pivotally supports the bellcrank 64. It should be noted that the bushing 66 has a shoulder portion that is received in a counterbore 68 of the cylinder block 22 around the threaded hole that receives the bolt 65 so as to axially position the lever 64 relative to the cylinder block 22.

Figure 4:
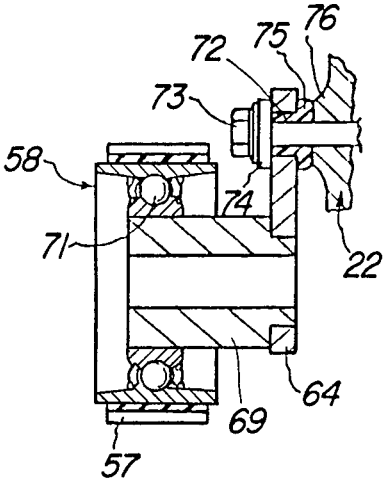
FIG. 4 is an enlarged cross-sectional view taken along the line 4—4 of the FIG. 2.
Figure 5:
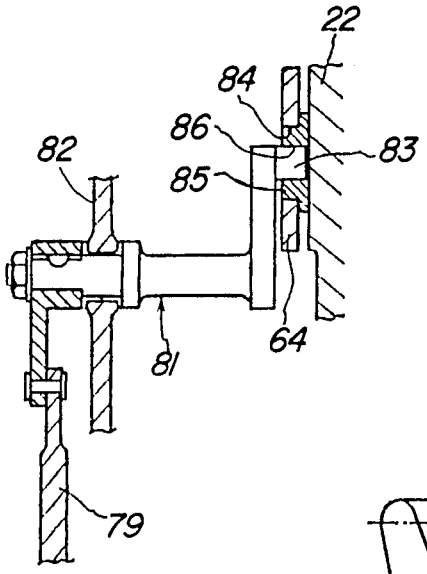
FIG. 5 is an enlarged cross-sectional view taken along the line 5—5 of FIG. 2.
Figure 6:
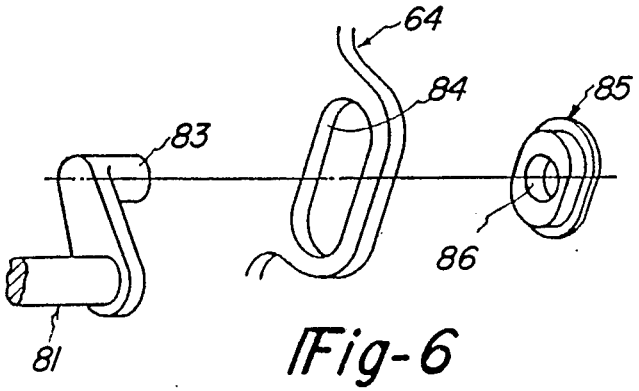
FIG. 6 is an enlarged perspective view of a portion of the apparatus as shown in FIG. 5.

The idler sprockets 58 and 59 are journaled at the outer ends of the arms of the bellcrank 64 by a construction as best shown in FIG. 4. As will be seen, a relatively large diameter post 69 extends outwardly from the respective arms of the bellcrank 64 and carries an anti-friction bearing 71 that journals the respective idler sprocket (the sprocket 58 in the portion shown in FIG. 4).

In order to prevent deflection of the arms of the bellcrank 64 and to insure good control, there are provided slots 72 of arcuate shape in the arms of the bellcrank 64 on either side of the shaft 69. The slots 72 curve about a center coincident with the pivot axis of the bellcrank 64. Bolts 73 extend through these slots and carry washers 74 that hold the bellcrank arms in engagement with a bushing 75 that is juxtaposed to a boss 76 of the cylinder block 22 so as to prevent any unwanted axial movement.

A mechanism is provided for pivoting the bellcrank 64 about the pivot pin 65 for varying the valve timing. This mechanism is indicated generally by the reference numeral 77 and is illustrated in most detail in FIGS. 2 and 5 and in an exploded fashion in FIG. 6. The mechanism 77 includes a powering vacuum motor 78 that is selectively supplied with a vacuum force for actuating a piston rod 79. The vacuum motor is operated by a control device (not shown) that is programmed to provide the desired strategy for the variable valve timing. The piston rod 79 is pivotally connected to one end of a crank shaped bellcrank, indicated generally by the reference numeral 81. The bellcrank 81 is pivotally supported by means of a plate 82 that is fixed in any known manner to the engine block. The opposite end of the bellcrank 81 is provided with an offset pivot pin 83 that extends through an elongated slot 84 formed in one of the arms of the bellcrank 64. In the illustrated embodiment, the slot 84 is formed adjacent the arm carrying the idler sprocket 58.

An intermediate sliding member 85 has a bore 86 that receives the bellcrank pin 83 and an oval shaped part that is slidably supported in the slot 84. As a result, pivotal movement of the bellcrank 81 will effect pivotal movement of the bellcrank 74 to effect a change in the valve timing, as will now be described.

FIG. 2 shows the mechanism at one extreme limit of the valve timing. In this condition, the vacuum motor 78 has been activated so as to cause the bellcrank 81 to move through an extreme counterclockwise position so that the bellcrank 64 has been rotated to an extreme counterclockwise position as determined by the length of the slot 72. In this position, the idler sprocket 58 is at the closest axial position to the plane containing the axes of rotation of the camshafts 45 and 48 while the idler sprocket 59 is at the maximum distance from the corresponding plane containing the axes of the camshafts 43 and 47. Under this condition, the valve events have a minimum overlap between the opening of the intake valves and the closing of the exhaust valves.

If it is desired to alter the valve timing to create more valve overlap, the bellcrank 81 is rotated in a clockwise direction by activating the vacum motor 78 so as to cause the rod 79 to push on the lower end of the bellcrank 81 to achieve this rotation. This will cause rotation of the bellcrank 64 in a clockwise direction about the pivot shaft 65 and cause the idler sprocket 58 to move downwardly away from the plane containing the axes of rotation of the camshafts 45 and 47 and the idler sprocket 59 to move upwardly toward the plane containing the axes of rotation of the camshafts 43 and 47. This movement will have the effect of causing the camshafts 45 and 48 to rotate clockwise and counterclockwise, respectively, so as to alter the valve events of the valves actuated thereby by increasing the valve overlap by opening the intake valves sooner and closing the exhaust valves later. At the same time, the camshafts 43 and 47 will be rotated in the clockwise and counterclockwise direction so as to alter the effect of the valve timing and valve events of the valves actuated thereby to increase the valve overlap in the same way. Thus, even though the idler sprockets 58 and 59 move in opposite directions, it should be noted that they cause their respective intake camshafts both to be rotated in a clockwise direction and their associated exhaust camshafts to be rotated in a counterclockwise direction. Hence, the camshafts are all rotated in the appropriate directions so that a single mechanism will simultanously effect the desired change in angular position of all camshafts relative to the crankshaft 29. It should be readily apparent that a very simple yet highly effective construction is accomplished and it will be insured that there will be equal angular rotation of all camshafts with the intake and exhaust camshafts rotating in opposite directions from each other.

Figure 7:
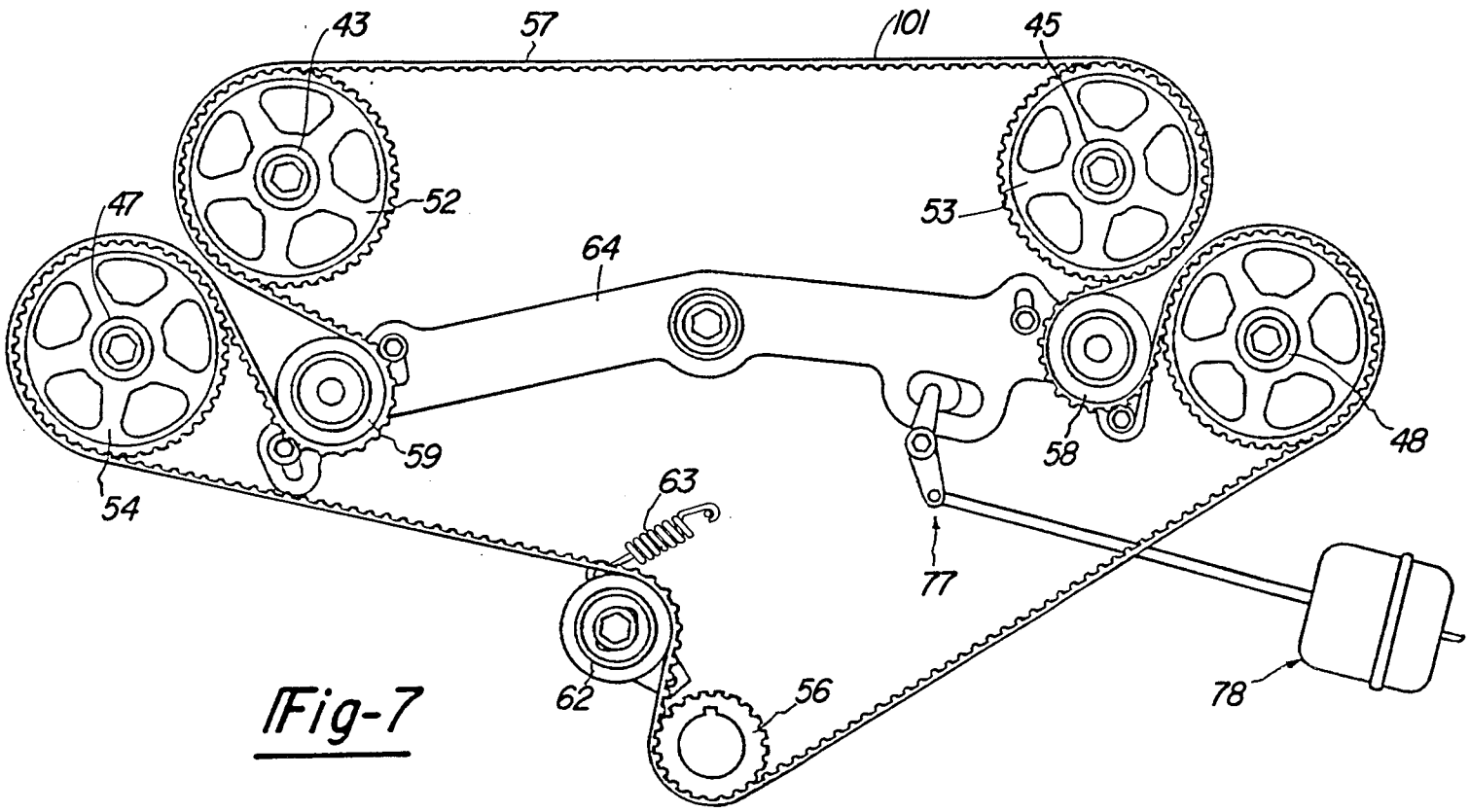
FIG. 7 is a front elevational view, in part similar to FIG. 2, showing the camshaft drive constructed in accordance with another embodiment of the invention.
Figure 8:
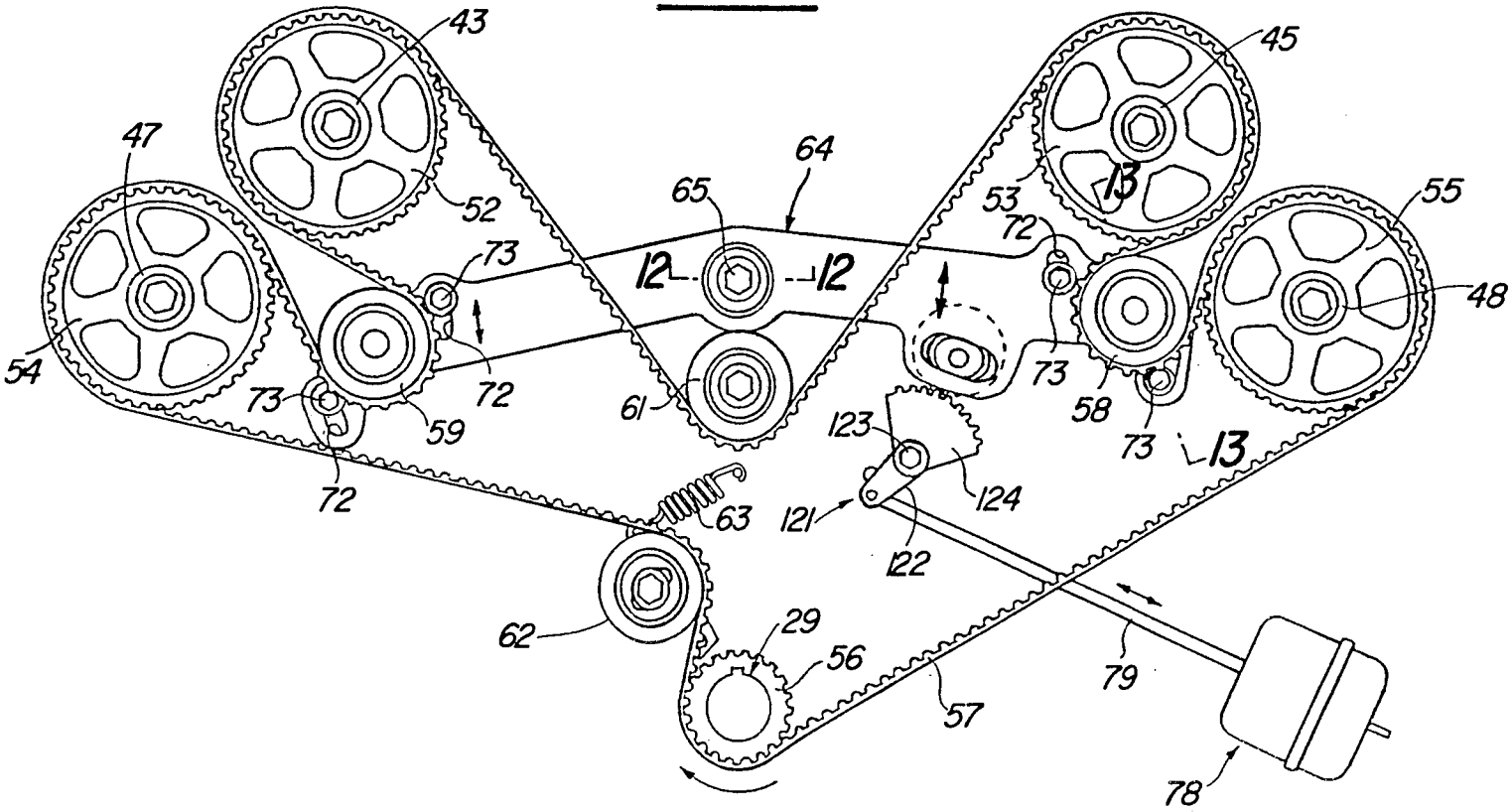
FIG. 8 is a front elevational view, in part similar to FIGS. 2 and 7, showing the camshaft drive of still a further embodiment of the invention.

FIG. 7 shows another embodiment of the invention which is basically the same as the embodiment of FIGS. 1 through 6. The only difference between the embodiment of FIG. 7 and the embodiment of FIGS. 1 through 6 is the relationship of the portion of the timing belt 57 that passes between the intake camshaft sprockets 53 and 52. For that reason, all components of this embodiment which are the same as the previously described embodiment have been identified by the same reference numerals and will be described again in detail only insofar as is necessary to understand the construction and operation of this embodiment.

Referring now specifically to FIG. 7, it will be noted that a flight 101 of the timing belt 57 extends in a straight line between the intake camshaft driving sprockets 52 and 53. That is, the idler sprocket 61 is eliminated in this embodiment. This is possible due to the fact that the sprockets 59 and 58 insure that there will be more than or nearly equal to 180 degrees of contact of the timing belt with the intake camshaft sprockets 52 and 53. As a result, there is no likelihood of the mechanism jumping out of time and, therefore the use of the idler sprocket 61 and the extra length of the timing belt necessitated thereby may be avoided.

FIGS. 8 through 14 shows another embodiment of the invention which is generally similar to the embodiment of FIGS. 1 through 6. Although the timing belt arrangement employed in FIGS. 1 through 6 is shown in the embodiment of FIGS. 8 through 14, it is to be understood that the timing belt arrangement of FIG. 7 may also be utilized in conjunction with this embodiment. This embodiment differs from the previously described embodiments primarily in the manner and structure for pivoting the bellcrank 64 and achieving the variable valve timing. For that reason, components which are the same as those components of the previous embodiments have been identified by the same reference numerals and will not be described again except insofar as is necessary to understand the construction and operation of this embodiment.

In this embodiment, the variable valve timing actuating mechanism is indicated generally by the reference numeral 121. The mechanism 121 is shown in most detail in FIGS. 8 through 11 and includes the vacuum motor 78 that operates an actuating rod 79. In this embodiment, the rod 79 is pivoted to one end of a lever 122 that is pivotally supported by the engine block or an intermediate member by means of a pivot pin 123. A sector gear 124 is affixed for rotation with the lever 122 and also rotates about the pivot pin 123.

The sector gear 124 meshes with a pinion gear 125 that is supported for rotation relative to the same supporting member as the pivot pin 123 by means of a pivot shaft 126. The pinion gear 125 also drives an eccentrically mounted pivot shaft 127 that is offset from the axis of the pivot pin 126. The offset pivot pin 127 is received in a bore of a slider member 128 that is received in a slot 129 of the arm of the bellcrank 64 that supports the idler sprocket 58. In this regard, the slot 129 is like the slot 84 of the previously described embodiment and the slider member 128 is like the slider member 85 of the previously described embodiment. Therefore, this embodiment differs from the previously described embodiment only in the manner in which the slider member 128 is moved in the slot 129 so as to effect pivotal movement of the bellcrank 64.

Figure 9:
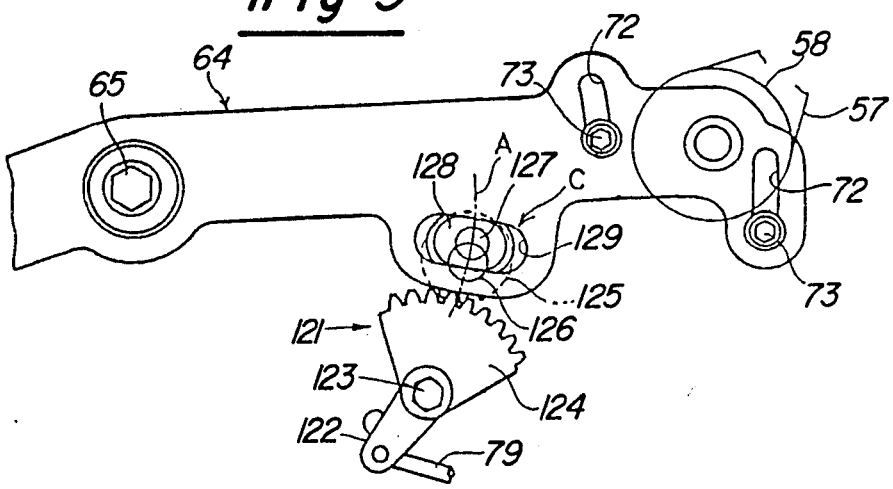
FIG. 9 is an enlarged view showing a portion of the timing adjustment mechanism of the embodiment of FIG. 8 in a first position.

FIG. 9 shows the mechanism in the position wherein there is minimum valve overlap and thus this position corresponds to the position of FIG. 2 of the embodiment of FIGS. 1 through 6. If it is desired to increase the valve overlap, the vacuum motor 78 is actuated so as to create a force on the piston rod 79 so as to rotate the sector gear in a clockwise direction to the position shown in FIG. 2. When this occurs, the gear 125 will rotate and the eccentric pin 126 will cause the slider 128 to move in the slot 129 and pivot the bellcrank 64 in a clockwise direction to the position shown in FIG. 10 for intermediate valve overlap.

Figure 11:
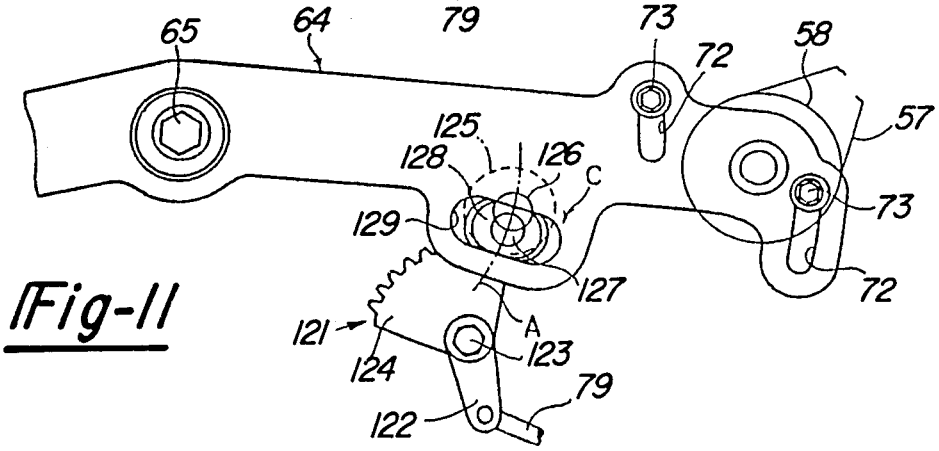
FIG. 11 is an enlarged view, in part similar to FIGS. 9 and 10, showing the mechanism in still a further position.

If even more overlap is required, the fluid motor is actuated in the opposite sense from the position shown in FIG. 9 so as to rotate the sector gear 124 in a counterclockwise direction and effect rotation of the pinion gear 125 from the position shown in FIG. 9 to the position shown in FIG. 11. When this occurs, the bellcrank 64 will be pivoted to the extreme of its movement in a clockwise direction and maximum valve overlap will be accomplished.

Figure 10:
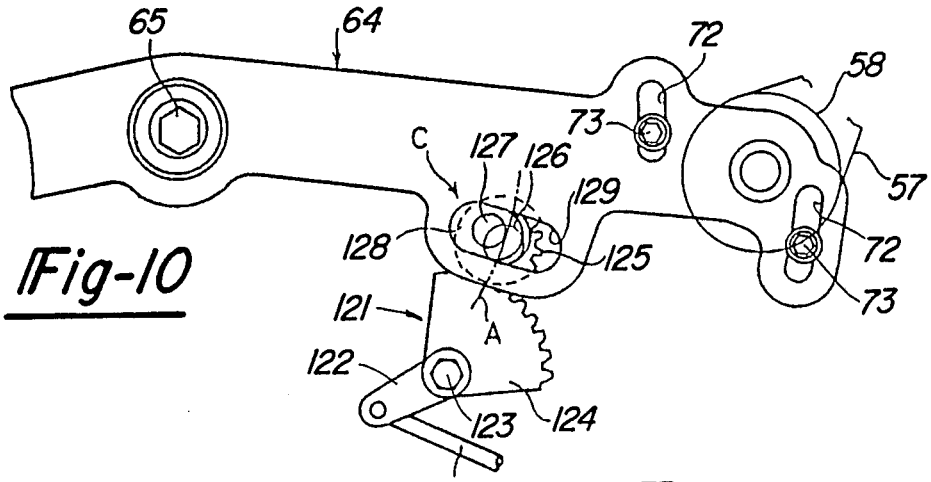
FIG. 10 is an enlarged view, in part similar to FIG. 9, showing the mechanism in another position.
Figure 14:
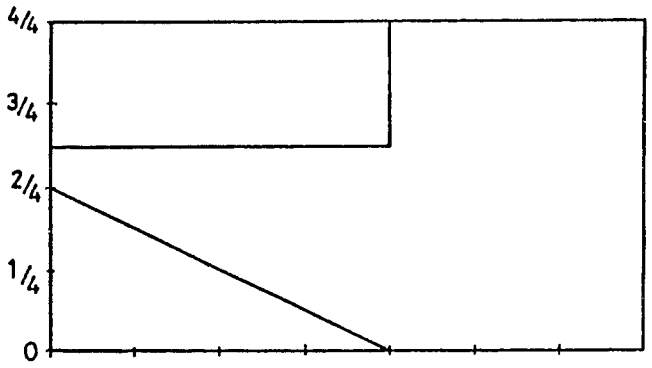
FIG. 14 is a graphical view showing the various operating conditions and value timing arrangement in accordance with those operating conditions.
Figure 16:
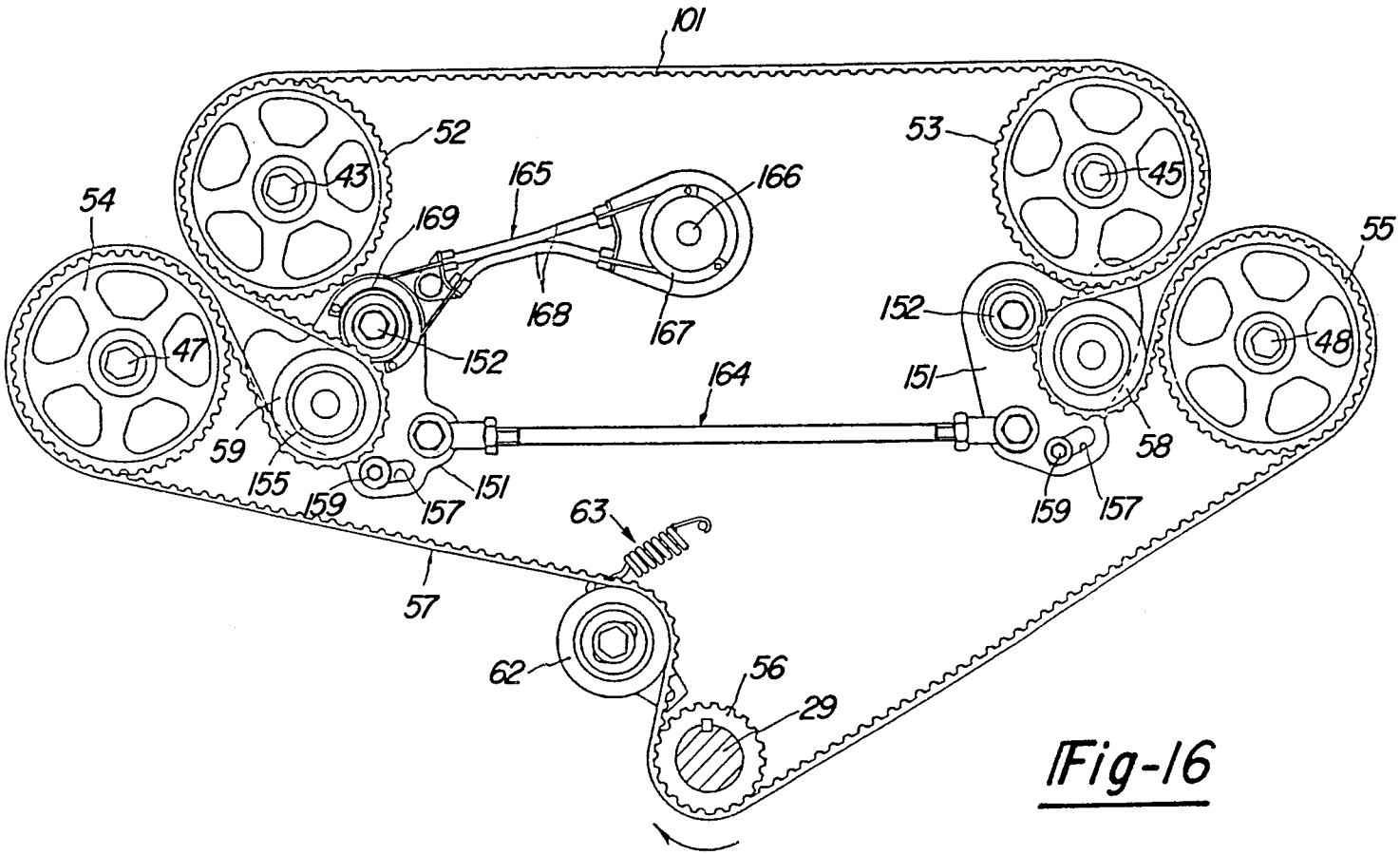
FIG. 16 is an end elevational view in part similar to FIGS. 2, 7 and 8 showing yet another embodiment of the invention.
Figure 17:
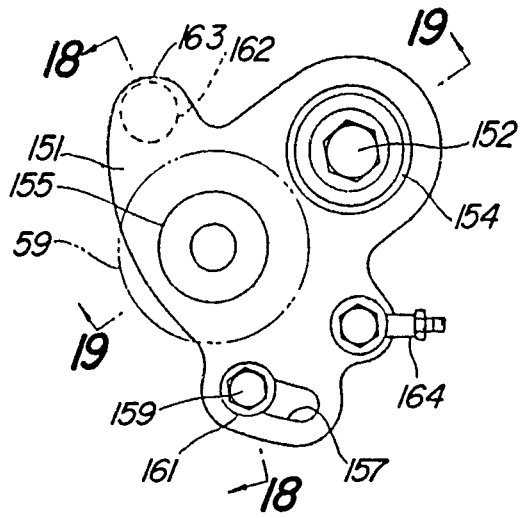
FIG. 17 is an enlarged view showing a portion of the timing adjustment mechanism of the embodiment of FIG. 16.
Figure 18:
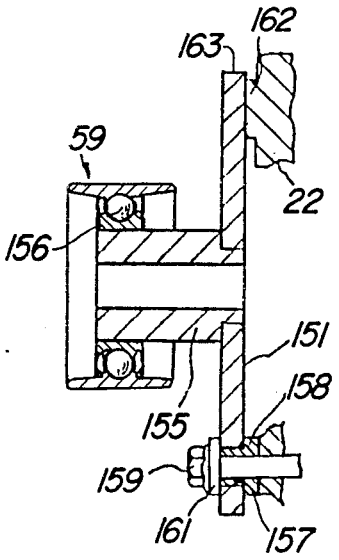
FIG. 18 is an enlarged cross-sectional view taken along the line 18—18 of FIG. 17.
Figure 19:
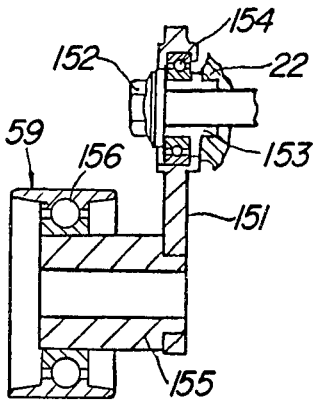
FIG. 19 is an enlarged cross-sectional view taken along the line 19—19 of FIG. 17.

FIG. 14 is a graph of engine speed versus engine load or throttle valve opening and shows the three various position possible for the valve timing wherein the area I indicates the position shown in FIG. 9 with minimum valve overlap, the position shown by the block II indicates the position shown in FIG. 10 with intermediate valve overlap, and the position shown in FIG. 11 is identified by the block III which shows the condition of maximum valve overlap. The strategy and engine running characteristics which may dictate which of the three positions are chosen will depend upon particular applications and those skilled in the art can readily make this determination based upon the foregoing description.

Figure 15:
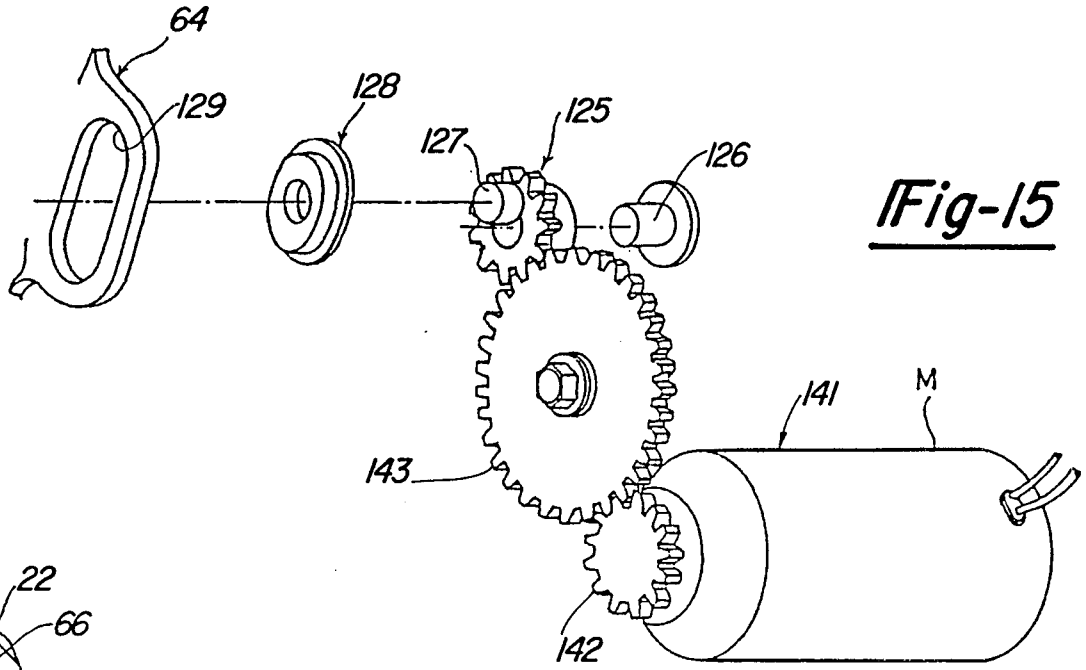
FIG. 15 is an enlarged, exploded perspective view showing another embodiment of the invention.
Figure 12:
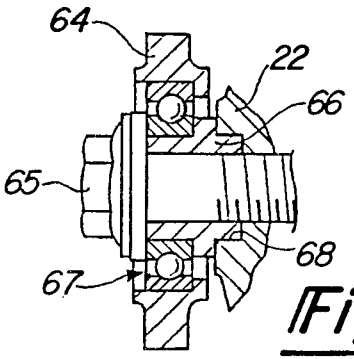
FIG. 12 is an enlarged cross-sectional view taken along the line 12—12 of FIG. 8.
Figure 13:
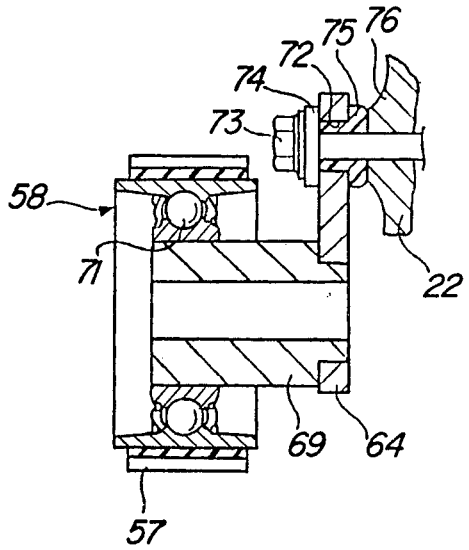
FIG. 13 is an enlarged cross-sectional view taken along the line 13—13 of FIG. 8.

In the embodiments of the invention thus far described, the powering device for achieving the variable valve timing has comprised a linear type fluid motor. FIG. 15 shows an embodiment which is generally similar to the embodiment of FIGS. 8 through 14 but wherein the pivotal movement of the bellcrank 64 and the achievement of the variable valve timing is accomplished by means of a rotary stepping motor, indicated generally by the reference numeral 141. The stepping motor 141 has an output shaft that drives a pinion gear 142 which is in mesh with a further pinion gear 143. The pinion gear 143 meshes with a pinion gear 125 similar to the pinion gear of the same reference numeral in the embodiments of FIGS. 8 through 14 so as to activate the bellcrank 54 in the manner as previously described. It is believed that this operation should be readily apparent to those skilled in the art and that a further discussion of it is unnecessary for that reason.

In the embodments of the invention as thus far described, the idler sprockets 58 and 59 were carried by a common bellcrank for their simultaneous movement. FIGS. 16 through 19 show another embodiment of the invention wherein the idler sprockets are independently supported but are coupled together for simultaneous movement by a construction to be described. In this embodiment, the camshaft driving arrangement of the type shown in FIG. 7 is employed and components which are the same as the components of that embodiment have been identified by the same reference numeral and will be described only insofar as is necessary to understand the construction and operation of this embodiment.

In this embodiment, each of the idler sprockets 58 and 59 is supported on a respective lever 151 that is pivotally supported on the adjacent cylinder bank of the engine by means including a pivot bolt 152. The pivot bolt 152 is threadedly engaged with the cylinder block 22 and is provided with an anti-friction bushing 153 which journals the lever 151 through the intermediary of an anti-friction bearing 154.

The lever carries a rigid outwardly extending post 155 which, in turn, journals the respective sprocket 58 or 59 by means of an anti-friction bearing 156.

Each lever 151 is provided with an arcuate slot 157 that receives an anti-friction bushing 158 which, in turn, is journaled on a pivot bolt 159 that is threaded into the cylinder block 22. A washer 161 bears against the lever 151 around the slot 157 so as to prevent axial displacement of the lever 151.

The cylinder block 22 is also provided with an outwardly extending projection 162 that bears against an arm 163 of the lever 151 so as to further add to its stability.

The levers 151 are interconnected for simultaneous pivotal movement in the same direction by means of an interconnecting link 164 which is adjustable in length so as to permit adjustment in the initial relative positions between the two levers 151.

A mechanism, indicated generally by the reference numeral 165, is provided for pivoting one of the levers 151 and the other of the levers 151 through the link 164. In the illustrated embodimen., the lever 151 associated with the sprocket 159 is so activated by means of an electric pulse motor 166 that is supported in the valley of the V of the engine and which is actuated in a suitable manner. The pulse motor 166 operates a pulley 167 to which one end of each pair of flexible transmitters 168 is connected. The opposite end of the flexible transmitters 168 are connected to an arcuate member 169 that is affixed to the lever 151 about the pivot pin 152. Accordingly, tensioning of one of the transmitters 168 and releasing of the other transmitter will effect pivotal movement of the levers 151 and, accordingly, the timing adjustment as aforedescribed.

Figure 20:
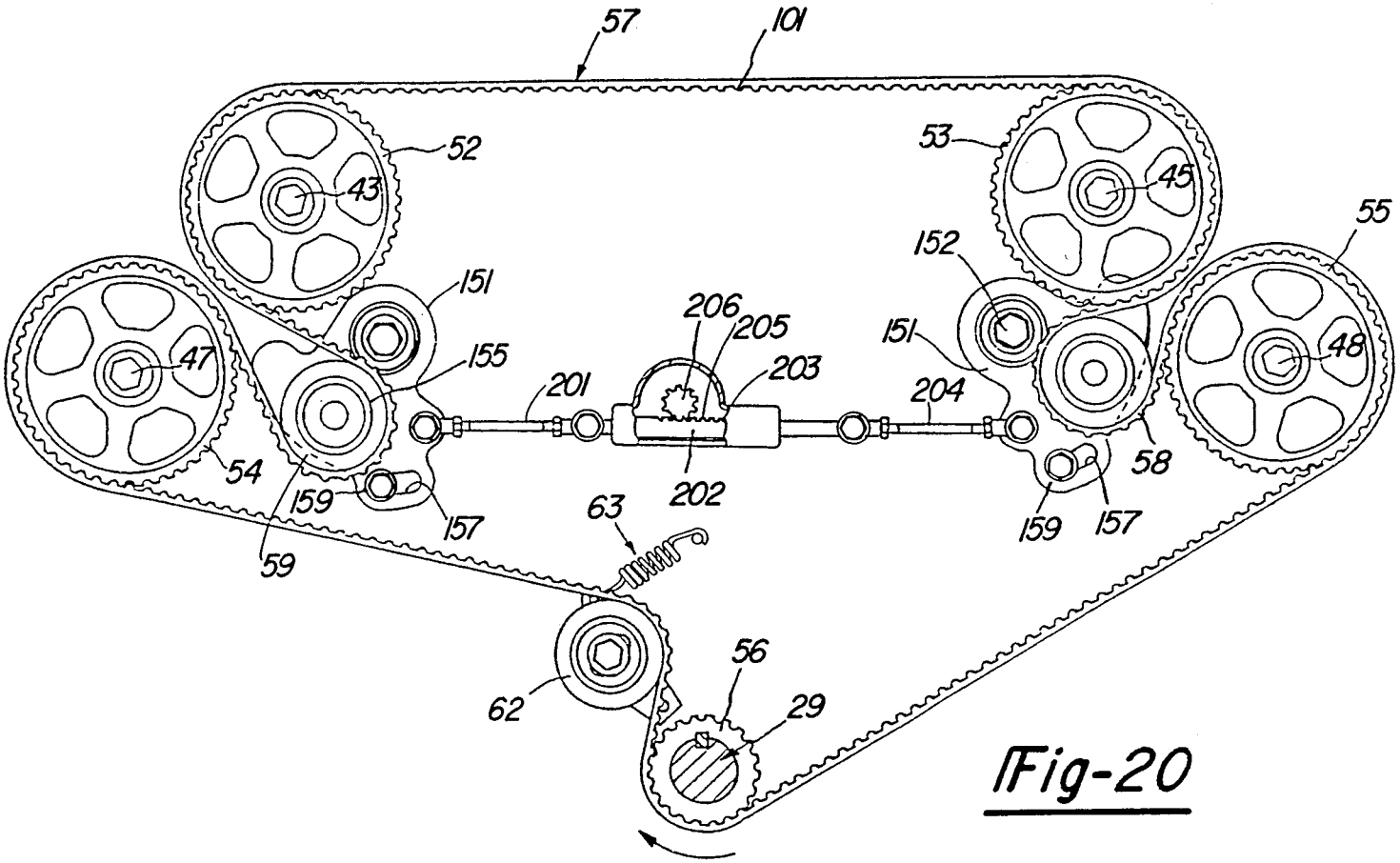
FIG. 20 is an end elevational view, in part similar to FIGS. 2, 7, 8 and 16 showing yet another embodiment of the invention.

FIG. 20 shows yet another embodiment of the invention which differs from the embodiment of FIGS. 16 through 19 only in the manner in which the levers 151 are interconnected and activated. For that reason, components of this embodiment which are the same as the previously described embodiments have been identified by the same reference numerals and will be described again only insofar as is necessary to understand the construction and operation of this embodiment.

Referring now in detail to FIG. 20, a first link 201 is pivotally connected at one end to the lever 151 associated with the sprocket 59. The opposite end of the link 201 is connected to a rack 202 that is slidably supported in a housing 203 that is affixed in any suitable manner to the engine. A second link 204 is pivotally connected at one of its ends to the lever 151 associated with the sprocket 58. The opposite end of the link 204 is pivotally connected to the other end of the rack 202.

The rack 202 is provided with gear teeth 205 which are in mesh with a pinion gear 206. The pinion gear 206 is driven by a stepping motor (not shown) that is activated in any suitable manner. Upon rotation of the gear 206, the rack 202 will move either to the left to pivot the levers 151 in a clockwise direction or to the right to pivot the levers 151 in a counterclockwise direction. Such pivotal movement varies the valve timing, as should be readily apparent from the foregoing description.

From the foregoing, those skilled in the art will readily realize that a number of embodiments of the invention have been illustrated and described and in each of which there is disclosed a very effective way for simultaneously rotating all camshafts of an engine having angularly disposed cylinder banks so as to achieve adjustment in valve timing. In addition, an improved form of driving the camshafts of such engines has been disclosed. Although a number of embodiments of the invention have been illustrated and described, further changes and modifications may be made without departing from the spirit and scope of the invention, as defined by the appended claims.

I claim:

1. A variable timing camshaft drive for an internal combustion engine having a first cylinder bank, a first camshaft rotating about a first axis for operating at least one valve associated with said first cylinder bank, a second cylinder bank disposed at an angle to said first cylinder bank, a second camshaft rotating about a second axis for operating at least one valve associated with said second cylinder bank, a drive sprocket driven by said engine and rotatable about a third axis, a single flexible transmitter trained about said first and said second camshafts and said drive sprocket for driving said first and said second camshafts in unison with each other, and means for simultaneously rotating said first and said second camshafts in the same direction relative to said drive sprocket for simultaneously changing the events of the valves operated by said camshafts in the same sense.

2. A variable timing camshaft drive as set forth in claim 1 wherein the means for simultaneously rotating the first and second camshafts comprises a first idler sprocket engaged with the flexible transmitter on the side thereof between said drive sprocket and said first camshaft in the direction of drive of said flexible transmitter, a second idler sprocket engaged with said flexible transmitter between said second camshaft and said drive sprocket in the direction of drive of said flexible transmitter, and means for simultaneously moving said first and said second idler sprockets for rotating the first and second camshafts in the same direction relative to said drive sprocket.

3. A variable timing camshaft drive as set forth in claim 2 wherein the first and second idler sprockets are supported by a common element for simultaneous movement.

4. A variable timing camshaft drive as set forth in claim 2 wherein the first and second idler sprockets are supported by respective pivotably mounted supports mechanically coupled together for simultaneous pivotal movement of said idler sprockets.

5. A variable timing camshaft drive as set forth in claim 4 wherein the means for moving the idler sprockets comprises means for pivoting one of the idler sprocket pivotal supports.

6. A variable timing camshaft drive as set forth in claim 4 wherein the means for simultaneously moving the idler sprockets comprises means for activating the mechanically coupling means between the supports of the idler sprockets.

7. A variable timing camshaft drive as set forth in claim 1 further including a third camshaft journaled relative to the first cylinder bank about an axis parallel to the first axis and for operating at least one other valve associated with the first cylinder bank and a fourth camshaft rotatably journaled relative to the second cylinder bank about an axis parallel to the second axis for operating at least one other valve associated with the second cylinder bank, the means for rotating the first and second camshafts in the same direction being operative to rotate the third and fourth camshafts in the same direction relative to the drive sprocket and in an opposite direction to the direction of rotation of the first and second camshafts.

8. A variable timing camshaft drive as set forth in claim 7 wherein the means for rotating the camshafts comprises a first idler sprocket engaged with the flexible transmitter between the first and third camshafts and a second idler sprocket engaged with the flexible transmitter between the second and fourth camshafts and means for supporting said idler sprockets for common movement.

9. A variable timing camshaft drive as set forth in claim 8 wherein the first and second idler sprockets are supported by a common element for simultaneous movement.

10. A variable timing camshaft drive as set forth in claim 8 wherein the first and second idler sprockets are supported by respective pivotally mounted supports mechanically coupled together for simultaneous pivotal movement of said idler sprockets.

11. A variable timing camshaft drive as set forth in claim 10 wherein the means for moving the idler sprockets comprises means for pivoting one of the idler sprocket pivotal supports.

12. A variable timing camshaft drive as set forth in claim 10 wherein the means for simultaneously moving the idler sprockets comprises means for activating the mechanical coupling means between the supports of the idler sprockets.

13. A variable timing camshaft drive system for an internal combustion engine as set forth in claim 1 wherein the first cylinder bank and the second cylinder bank are disposed at a V to each other and wherein the portion of the flexible transmitter extending between the first and the second camshafts comprises a single straight flight not engaged with an idler sprocket.

14. A variable timing camshaft drive system as set forth in claim 13 wherein the means for simultaneously rotating the first and second camshafts comprises a first idler sprocket engaged with the flexible transmitter on the side thereof between said drive sprocket and said first camshaft in the direction of drive of said flexible transmitter, a second idler sprocket engaged with said flexible transmitter between said second camshaft and said drive sprocket in the direction of drive of said flexible transmitter, and means for simultaneously moving said first and said second idler sprockets for rotating the first and second camshafts in the same direction relative to said drive sprocket.

15. A camshaft drive system for an internal combustion engine comprising a first cylinder bank, a first cylinder head affixed to said first cylinder bank and defining at least a first combustion chamber, first and second camshafts journaled for rotation relative to said first cylinder head about parallel first and second axes, a second cylinder bank disposed at an angle to said first cylinder bank, a second cylinder head affixed to said second cylinder bank and defining at least a second combustion chamber, third and fourth camshafts journaled for rotation relative to said second cylinder head about parallel third and fourth axes, a drive sprocket driven by said engine, and a flexible transmitter trained around said drive sprocket and said first, second, third and fourth camshafts for driving all of said camshafts in unison with said drive sprocket, the portion of said flexible transmitter extending between said second and said third camshafts comprising a single straight flight not engaged with an idler sprocket.

16. A camshaft drive system as set forth in claim 15 further comprising a first idler sprocket engaged with the flexible transmitter between the first and second camshafts and a second idler sprocket engaged with the flexible transmitter between the third and fourth camshafts.

17. A camshaft drive system as set forth in claim 16 wherein the axes of rotation of the idler sprockets are disposed between a plane containing the axes of the associated camshafts and a parallel plane containing the axis of the crankshaft.

18. A camshaft drive system as set forth in claim 17 wherein the distance between the camshaft sprockets is less than the diameter of the idler sprockets.

* * * * *